US010360848B2

(12) United States Patent
Wang

(10) Patent No.: US 10,360,848 B2
(45) Date of Patent: Jul. 23, 2019

(54) PIXEL COMPENSATING CIRCUIT

(71) Applicant: EverDisplay Optronics (Shanghai) Limited, Shanghai (CN)

(72) Inventor: Huannan Wang, Shanghai (CN)

(73) Assignee: EVERDISPLAY OPTRONICS (SHANGHAI) LIMITED, Shanghai (CN)

( * ) Notice: Subject to any disclaimer, the term of this patent is extended or adjusted under 35 U.S.C. 154(b) by 220 days.

(21) Appl. No.: 15/214,778

(22) Filed: Jul. 20, 2016

(65) Prior Publication Data

US 2017/0025062 A1 Jan. 26, 2017

(30) Foreign Application Priority Data

Jul. 24, 2015 (CN) ..... 2015 1 0444054

(51) Int. Cl.
*G09G 3/3233* (2016.01)

(52) U.S. Cl.
CPC ... *G09G 3/3233* (2013.01); *G09G 2300/0819* (2013.01); *G09G 2310/0216* (2013.01); *G09G 2310/0262* (2013.01); *G09G 2320/045* (2013.01)

(58) Field of Classification Search
None
See application file for complete search history.

(56) References Cited

U.S. PATENT DOCUMENTS

2012/0098877 A1* 4/2012 Taro ..... G09G 3/3225 345/691
2014/0168180 A1* 6/2014 Kim ..... H05B 33/0896 345/205
2014/0300937 A1 10/2014 Choe
2014/0320550 A1* 10/2014 Liao ..... G09G 3/3225 345/690

FOREIGN PATENT DOCUMENTS

CN 102098855 A 6/2011
CN 102385834 A 3/2012

* cited by examiner

*Primary Examiner* — Christopher R Lamb
(74) *Attorney, Agent, or Firm* — Andrew F. Young, Esq.; Lackenbach Siegel, LLP

(57) ABSTRACT

The disclosure comprises a first to a seventh transistor, a capacitor and a light-emitting diode, the second end of the first transistor, the first end of the fifth transistor and one end of the capacitor being connected at the first node, the first end of the second transistor, the control end of the third transistor and the other end of the capacitor being connected at the second node. The second ends of the second, the third and the forth transistor is connect at the third node, the first end of the forth transistor and the first end of the seventh transistor is connected to the anode of the light-emitting diode. The second end of the sixth transistor is connected to the second node, and the second end of the fifth transistor, the first end of the sixth transistor and the second end of the seventh transistor connect with each other.

2 Claims, 5 Drawing Sheets

PIXEL COMPENSATING CIRCUIT

CROSS-REFERENCE TO RELATED APPLICATIONS

The present application claims priority to and the benefit of Chinese Patent Application No. CN 201510444054.1, filed on Jul. 24, 2015, the entire content of which is incorporated herein by reference.

BACKGROUND OF THE DISCLOSURE

Field of the Disclosure

The disclosure relates to the field of display, more specifically, to the design of the AMOLED pixel circuit, and mainly provides a pixel circuit compensating the threshold voltage of the driving transistor.

Background

Traditional active matrix organic light-emitting diodes use 2T1C pixel driving mode, a switch transistor, a driving transistor and a storage capacitor to control the emitting of diodes. When the scanning signal is effective, the switch transistor is switched on to store the data signal in the storage capacity, the voltage signal stored by the storage capacity controls the conduction of the driving transistor, transforms the input data voltage signal into current signal, which the OLED need to emit to display different gray-scale. The main contradiction of the prior art is the threshold voltage of each driving transistor exists larger error with the process differences. With the low gray-scale images, using 2T1C structure may cause the difference between adjacent transistors reach to 20%. At the same time, when the size of the pixel power cord is longer, the power supply of the pixel circuit generates a larger IR drop, which causes serious uneven gray level. As a result, the pixel circuit actually applied eliminates the problems of short-range display and uneven length caused by the threshold voltage and IR Drop of transistors by the way of increasing circuits to compensate the threshold voltage and IR Drop. The design of the pixel circuit in prior art usually uses a compensating circuit in order to compensate the threshold voltage of driving thin-film transistor (TFT), such as in conventional 6T1C pixel circuit, mainly uses a single pixel circuit with compensation effect composed of six PMOS thin-film transistors and a storage capacitor, such a pixel compensating circuit often requires complex time sequence control, and the parameters of the electric current passing through the light-emitting diode have high correlation with the power supply voltage, so the compensation effect is poor.

SUMMARY OF THE DISCLOSURE

In an alternative embodiment, the disclosure provides a pixel compensating circuit, comprising: a first transistor, a second transistor, a third transistor, a fourth transistor, a capacitor and a light-emitting diode; wherein each transistor of the first to the fourth transistor comprises a control end, a first end and a second end; the second end of the first transistor and one end of the capacitor are connected at a first node, the first end of the second transistor, the control end of the third transistor and the other end of the capacitor are connected at a second node, the second ends of the second, the third and the fourth transistor are connected at a third node; and wherein, the first end of the first transistor is inputted with a data voltage signal, the control ends of the first and the second transistor are driven by a first scanning signal, the first end of the third transistor receives a first reference voltage source, the control end of the fourth transistor is driven by an enable signal, the first end of the fourth transistor is connected to an anode of the light-emitting diode, and a cathode of the light-emitting diode is connected to a second reference voltage source.

The above-mentioned pixel compensating circuit further comprises a fifth transistor comprising a control end, a first end and a second end; wherein the first end of the fifth transistor is connected to the first node, and its second end of the fifth transistor is applied with an initialization voltage signal, and the control end of the fifth transistor is applied by the enable signal.

The above-mentioned pixel compensating circuit further comprises a sixth transistor comprising a control end, a first end and a second end; wherein the first end of the sixth transistor is applied an initialization voltage signal, the second end of the sixth transistor is connected to the second node, the control end of the sixth transistor is applied by a second scanning signal.

The above-mentioned pixel compensating circuit further comprises a seventh transistor comprising a control end, a first end and a second end; wherein the second end of the seventh transistor is applied with an initialization voltage signal, the first end of the seventh transistor is connected to the anode of the light-emitting diode, the control end of the seventh transistor is applied by a second scanning signal.

The above-mentioned pixel compensating circuit further comprises a fifth and a sixth transistor; wherein each of the fifth and the sixth transistor comprises a control end, a first end and a second end, the first end of the fifth transistor is connected to the first node, the second end of the sixth transistor is connected to the second node, and an initialization voltage signal is inputted to the second end of the fifth transistor and the first end of the sixth transistor, wherein a driving timing of the pixel compensating circuit comprises:

an initialization phase, wherein the second scanning signal driving the sixth transistor has a first logic state to switch on the sixth transistor, and initialize a potential of the second node to equal to a potential $V_{INT}$ of the initialization voltage signal;

a data writing phase, wherein the first scanning signal has a first logic state to switch on the first and the second transistor, the data voltage signal $V_{DATA}$ is written to the first node, so as to clamp the potential of the second node to equal to the voltage value the a voltage $V_{DD}$ of the first reference voltage source minus a threshold voltage $V_{TH}$ of the third transistor;

an emitting phase, wherein the enable signal driving the fourth and the fifth transistor has a first logic state, to switch on the fourth and the fifth transistor to drive the light-emitting diode to emit light, and make the potential of the second node jump to equal to $V_{DD}-V_{TH}-(V_{DATA}-V_{INT})$.

Here the first logic state is, for example, a low level, conversely the second logic state is a high level; and during the initialization phase, the enable signal is a high level to switch off the fourth and the fifth transistor, the first scanning signal is a high level to switch off the first and the second transistor; during the data writing phase, the enable signal is a high level to switch off the fourth and the fifth transistor, the second scanning signal is a high level to switch off the sixth and the seventh transistor; during the emitting phase, the first and the second scanning signal are high level to switch off the first and the second transistor, and also the sixth and the seventh transistor.

The above-mentioned pixel compensating circuit further comprises a seventh transistor, comprising a control end, a first end and a second end; wherein the second end of the seventh transistor is applied with the initialization voltage signal, the first end of the seventh transistor is connected to the anode of the light-emitting diode; and during the initialization phase, the second scanning signal also drives the seventh transistor to switch the seventh transistor on, to refresh the anode of the light-emitting diode during the initialization phase.

The above-mentioned pixel compensating circuit, during the emitting phase of the light-emitting diode, electric current $I_D$ passing through the third transistor and the light-emitting diode satisfies:

$$I_D = \frac{1}{2} \times \mu \times C_{OX} \times \frac{W}{L} \times (V_{DATA} - V_{INT})^2$$

wherein μ represents a carrier mobility of the third transistor, $C_{OX}$ represents a capacitance of gate oxide of the third transistor per unit area, and W/L represents a ratio of width and length of a channel of the third transistor.

BRIEF DESCRIPTIONS OF THE DRAWINGS

The accompanying drawings, together with the specification, illustrate exemplary embodiments of the present disclosure, and, together with the description, serve to explain the principles of the present disclosure.

DETAILED DESCRIPTION

Figure 1:
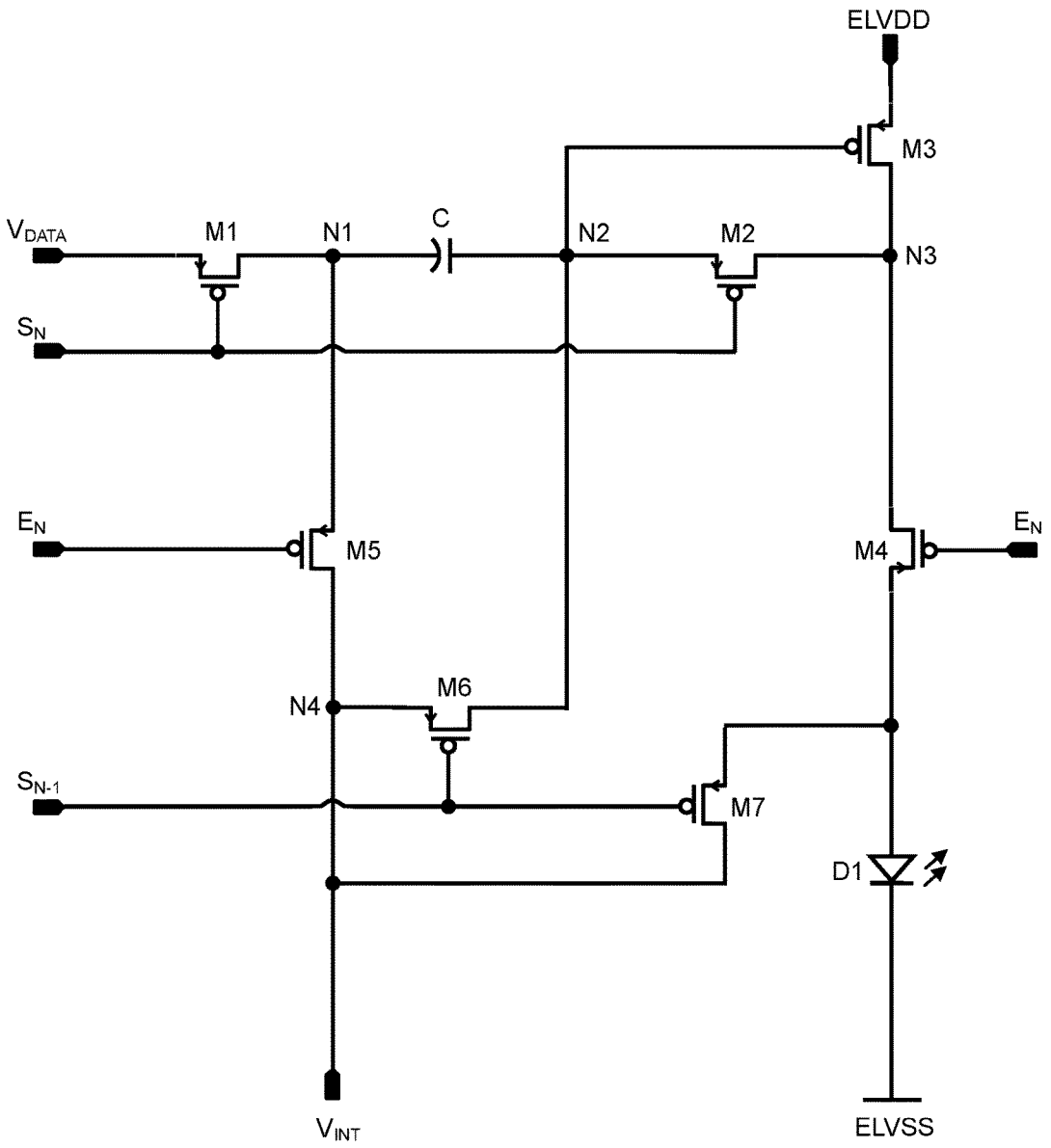
FIG. 1 is the basic framework of the pixel compensating circuit related to the disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

The pixel compensating circuit shown in FIG. 1 only shows a sub-pixel as a demonstration, a real AMOLED should have arrays comprising a plurality of such sub-pixel circuit. In the pixel compensating circuit, the second end of the first transistor M1 and one end of the storage capacitor C are connected at a first node N1, the other end of the capacitor C and the first end of the second transistor M2 are connected at a second node N2, and the gate control end of the third transistor M3 as the driving transistor is also connected to the second node N2. At the same time, the second end of the second transistor M2 the second end of the third transistor M3, and the second end of the fourth transistor M4 are connected at a third node N3 together, and the first end of the fourth transistor M4 is connected to the anode of a light-emitting diode D1, the cathode of the light-emitting diode is connected to a second reference voltage source ELVSS, and the first end of the third transistor M3 is connected to a first reference voltage source ELVDD, wherein the first reference voltage source ELVDD is relatively a voltage source with high level, while the second reference voltage source ELVSS is relatively a voltage source with low level, and the former is greater than the latter.

Referring to FIG. 1, the first end of the fifth transistors M5 is also connected to the first node N1, the second end of the fifth transistors M5 is connected to a fourth node N4. The first end of the sixth transistor M6 is also connected to the fourth node N4, and the second end of the sixth transistor M6 is connected to the second node N2, the second end of the seventh transistor M7 is also connected to the fourth node N4, yet the first end of the seventh transistor M7 is connected to the anode of the light-emitting diode D1;and an initialization voltage $V_{INT}$ is inputted into the second end (the fourth node N4) of the fifth transistor M5, so the first end of the sixth transistor M6 and the second end of the seventh transistor M7 are coupled to the initialization voltage $V_{INT}$.

Referring to FIG. 1, a data voltage signal $V_{DATA}$ is inputted into the first end of the first transistor M1, and a first scanning signal $S_N$ is inputted into the gate control ends of both the first transistor M1 and the second transistor M2; the first transistor M1 and the second transistor M2 are applied by the first scanning signal $S_N$ at the same time; and an enabling signal $E_N$ is inputted into the gate control ends of both the fourth transistor M4 and fifth transistors M5, the fourth transistor M4 and the fifth transistors M5 are applied by the enabling signal $E_N$ at the same time. In addition, a second scanning signal $S_{N-1}$ is inputted into the gate control ends of both the sixth transistor M6 and the seventh transistor M7, the sixth transistor M6 and the seventh transistor M7 are applied by the second scanning signal $S_{N-1}$ at the same time. In an optional but nonrestrictive embodiment, the type of seven transistors here of the first transistor M1 to the seventh transistor M7 may be PMOS conducting channel type, and their own first end, for example, can be a source end, and the corresponding second end can be a drain end. As electronic switches, the control ends of transistors M1~M7 can control the switching-on or switching-off between their own first end and second end.

Figure 2:
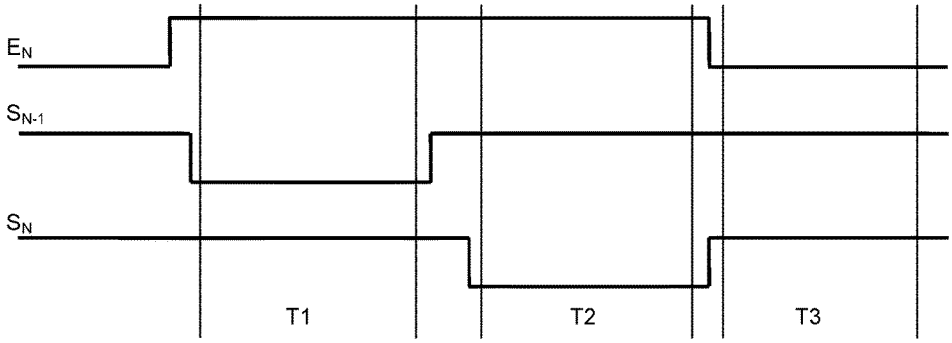
FIG. 2 is the time sequence control of the pixel compensating circuit related to the disclosure.

FIG. 2 is a main driving timing sequence mode of the driving pixel compensating circuit, its timing sequence is mainly divided into three phases T1~T3 that are continuous on the timeline. Specifically, during the first phase T1, the enable signal $E_N$ and the first scanning signal $S_N$ both are logic high level state, while the second scanning signal $S_{N-1}$ is logic low level state. During the second phase T2, the enable signal $E_N$ and the second scanning signal $S_{N-1}$ both are logic high level state, while the first scanning signal $S_N$ is logic low level state. During the third phase T3, the enable signal $E_N$ is logic low level state, while the first scanning signal $S_N$ and the second scanning signal $S_{N-1}$ both are logic high level state. The illumination of AMOLED involved in the content disclosed in this application document needs to go through these three processes T1~T3 throughout, the following content will respectively elucidate the switch response actions of each transistor M1~M7 to describe how to illumine OLED based on the three phases. In addition, for the convenience of understanding, in the subsequent embodiments of FIGS. 3-5, transistors depicted by dotted lines represents it is switched-off, whereas transistors depicted by solid lines represents it is switched-on.

Figure 3:
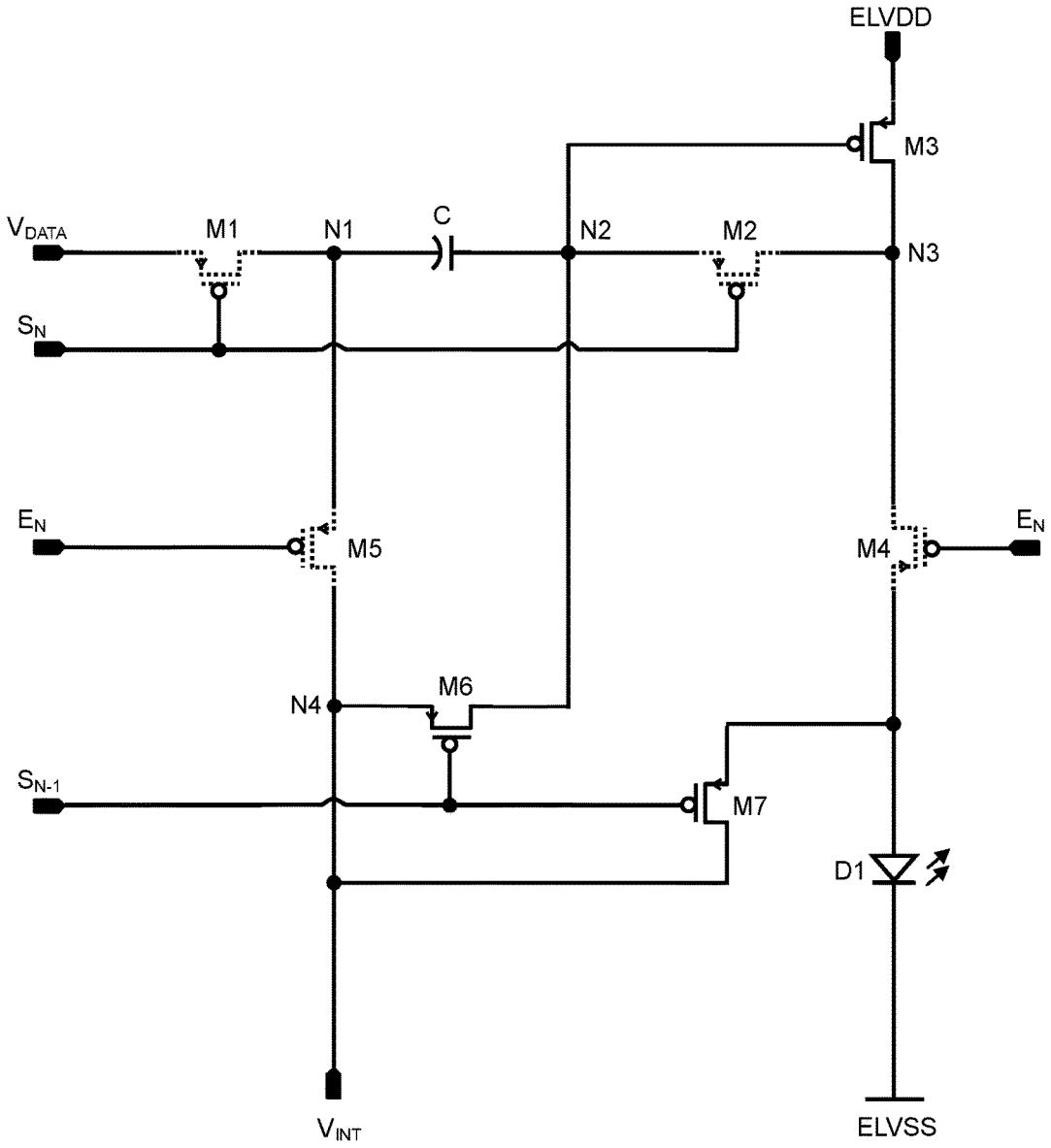
FIG. 3 is a diagram of a response of the pixel compensating circuit based on the initialization phase of the time sequence control in FIG. 2.

Referring to FIG. 2 and FIG. 3, during the first phase T1, the fourth transistor M4 and the fifth transistor M5 applied by the enable signal $E_N$ are both switched off because their gate control ends are both logic high level. At the same time, the first transistor M1 and the second transistor M2 applied by the first scanning signal $S_N$ are both switched off because their gate control ends are both logic high level. Yet, the sixth transistor M6 and the seventh transistor M7 are both switched on because their gate control ends are both logic low level. The initialization voltage $V_{INT}$ can be set to be lower voltage level, to make the gate of the third transistor M3 reset by utilizing the initialization voltage $V_{INT}$ through the switched-on sixth transistor M6, and write the initialization voltage $V_{INT}$ to the second node N2, and, at the same time, make the voltage of the other end of the storage capacitor C connecting to the second node N2 also perform an initialize program, which is to implement the so-called initialization of the storage capacitor C in the field. In addition, in order to remove the residual charged in the anode tap of the light-emitting diode D1, we also need to refresh the anode of the light-emitting diode D1 to increase of service life of such light-emitting diode type components of OLED, so the initialization voltage $V_{INT}$ also initializes the anode of the light-emitting diode D1 through the switched-on seventh transistor M7, to make the anode potential close to the initialization voltage $V_{INT}$. At the same time, the first reference voltage source ELVDD is written in the third node N3 through the switched-on third transistor M3 as the driving transistor, to make the potential of the third node N3 close to the actual voltage value $V_{DD}$ of the first reference voltage source ELVDD. Commonly, the first phase T1 refers to the initialization phase.

Figure 4:
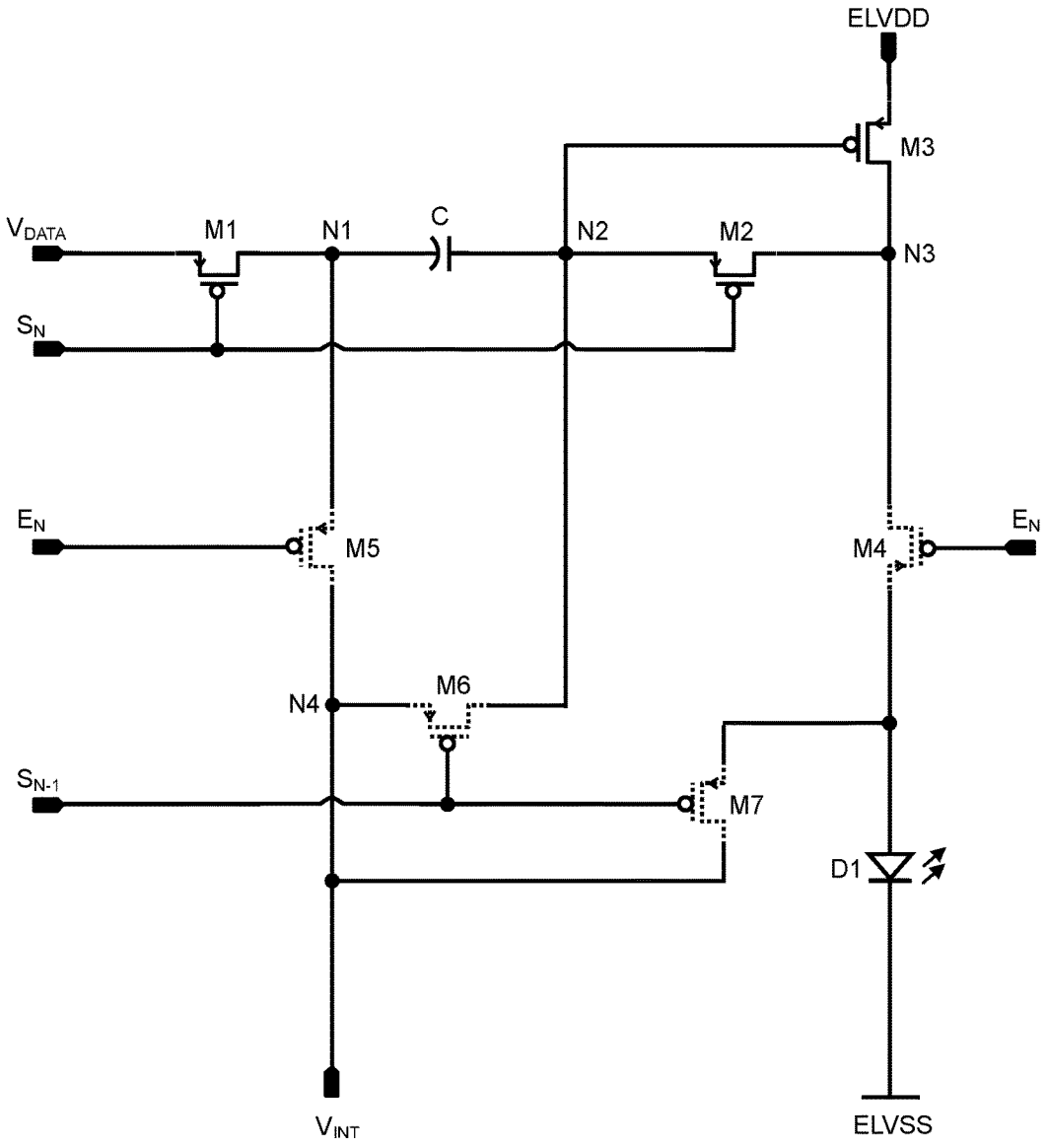
FIG. 4 is a diagram of a response of the pixel compensating circuit based on the data writing phase of the time sequence control in FIG. 2.

Referring to FIG. 2 and FIG. 4, in the another second phase T2 after the first phase T1, the fourth transistor M4 and the fifth transistor M5 applied by the enable signal $E_N$ are both switched off because their gate control ends still maintain logic high level. At the same time, the first transistor M1 and the second transistor M2 applied by the first scanning signal $S_N$ are both switched on because their gate control ends both reverse to logic low level. Yet, the sixth transistor M6 and the seventh transistor M7 applied by the second scanning signal $S_{N-1}$ are both switched off because their gate control ends both reverse to logic high level. Now the data voltage signal $V_{DATA}$ provided by the data-line is input to the first end of the first transistor M1, the data voltage signal $V_{DATA}$ charges the end of the storage capacitor C connecting to the first node N1 through the switched-on first transistor M1, to make the charging voltage level of the first node N1 roughly equal to the voltage level of the data voltage signal $V_{DATA}$. While the switched-on second transistor M2 and third transistor M3 will form a current path along a path from the first end of the third transistor M3, to the third node N3, then to the second node N2; since the first end of the third transistor M3 is applied a first reference voltage source ELVDD with high voltage level, the first reference voltage source ELVDD will charge the other end of the storage capacitor C connecting to the second node N2, and the charging continues to a threshold state eventually reached, the threshold state refers to the charging voltage level of the second node N2 roughly equal to the actual voltage value $V_{DD}$ of the first reference voltage source ELVDD minus the threshold voltage $V_{TH}$ of the third transistor M3 as the driving transistor, which is roughly equal to $V_{DD}-V_{TH}$, and at this point the voltage level of the second node N2 will directly cause the third transistor M3 to enter the off state, so the response action herein of the third transistor M3 reflects that it is essentially equivalent to a source follower. Usually, the second phase T2 refers to the data writing phase.

Figure 5:
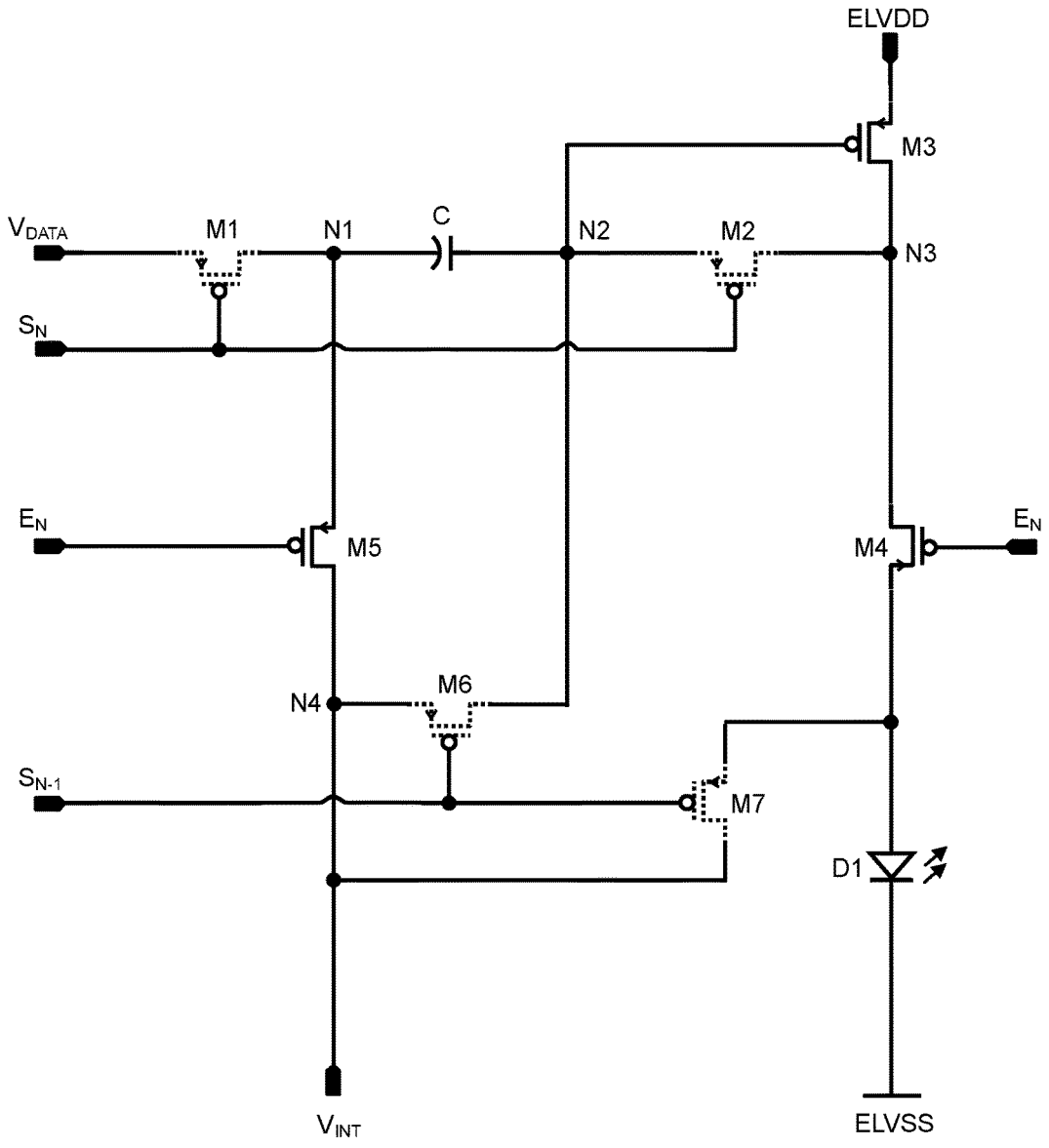
FIG. 5 is a diagram of the response of the pixel compensating circuit based on the emitting phase of the time sequence control in FIG. 2.

Referring to FIG. 2 and FIG. 5, in the third phase T3 after the second phase T2, the fourth transistor M4 and the fifth transistor M5 applied by the enable signal $E_N$ are both switched on because their gate control ends both reverse to logic high level during this phase. At the same time, the first transistor M1 and the second transistor M2 applied by the first scanning signal $S_N$ are both switched off because their gate control ends both reverse to logic high level. Yet, the sixth transistor M6 and the seventh transistor M7 applied by the second scanning signal $S_{N-1}$ are both switched off because their gate control ends still maintain logic high level. At this point, the second node N2 is in a floating status, but the switch-off of the first transistor M1 and the switch-on of the fifth transistors M5 cause the voltage of the first node N1 to experience an instantaneous jump from the voltage level of the data voltage signal $V_{DATA}$ during the second phase T2 to the initialization voltage $V_{INT}$, and to be charged to the initialization voltage $V_{INT}$; the coupling effect of the storage capacitor C will cause the actual voltage level of the second node N2 roughly equivalent to $V_{DD}-V_{TH}-(V_{DATA}-V_{INT})$. Usually, the third phase T3 refers to the illumining or the emitting phase. We take the desired voltage value of the second node N2 because we need to use the voltage of this node to drive the third transistor M3, and to make the threshold voltage of the third transistor M3 drift or the drift of the supply voltage $V_{DD}$ no longer be the key factor influencing the luminous intensity of the light-emitting diode D1, and the essence of the luminous intensity of the light-emitting diode D1 is closely related with electric current $I_D$ passing through it. The electric current $I_D$ passing through the third transistor M3 satisfies the following functional relations:

$$I_D = \frac{1}{2} \times \mu \times C_{OX} \times \frac{W}{L} \times (V_{SG} - V_{TH})^2 \quad (1)$$

$$I_D = \frac{1}{2} \times \mu \times C_{OX} \times \frac{W}{L} \times \{V_{DD} - [V_{DD} - V_{TH} - (V_{DATA} - V_{INT})] - V_{TH}\}^2 \quad (2)$$

$$I_D = \frac{1}{2} \times \mu \times C_{OX} \times \frac{W}{L} \times (V_{DATA} - V_{INT})^2 \quad (3)$$

Seen from the calculation of the functional relations (1) to (3), especially in view of the final electric current $I_D$ passing through the driving transistor, which is the third transistor M3 and the light-emitting diode D1, the electric current $I_D$ has nothing to do with the supply voltage $V_{DD}$, which may having fluctuation, the electric current $I_D$ is only associated with the relatively stable data voltage $V_{DATA}$ and the relatively stable initialization voltage $V_{INT}$, which can greatly avoid negative effects of the supply voltage $V_{DD}$ caused by the IR drop effect, this result is desired by those skilled in the art. The parameter μ appeared in the functional relations represents the carrier mobility of the third transistor M3, the parameter $C_{OX}$ represents the capacitance of gate oxide of the third transistor M3 per unit area, and the parameter W/L represents the ratio of width and length of the channel of the third transistor M3. Also, it should be notice that the initialization voltage $V_{INT}$ and the threshold voltage $V_{TH}$ here can also respectively take the absolute value sign to conform the understanding of the calculation for readers.

The foregoing is only the preferred embodiments of the disclosure, not thus limiting embodiments and scope of the disclosure, those skilled in the art should be able to realize that the schemes obtained from the content of specification and figures of the disclosure are within the scope of the disclosure.

What is claimed is:

1. A pixel compensating circuit, comprising: a first transistor, a second transistor, a third transistor, a fourth transistor, a capacitor and a light-emitting diode, wherein each transistor of the first to the fourth transistor comprises a control end, a first end and a second end; the second end of the first transistor and one end of the capacitor are connected at a first node, the first end of the second transistor, the control end of the third transistor and the other end of the capacitor are connected at a second node, the second ends of the second, the third and the fourth transistor are connected at a third node; and wherein the first end of the first transistor is applied with a data voltage signal, the control ends of the first and the second transistor are applied by a first scanning signal, the first end of the third transistor is connected to a first reference voltage source, the control end of the fourth transistor is applied by an enable signal, the first end of the fourth transistor is connected to an anode of the light-emitting diode, and a cathode of the light-emitting diode is connected to a second reference voltage source;

further comprising a seventh transistor having a control end, a first end and a second end;

wherein, the second end of the seventh transistor is inputted with an initialization voltage signal, the first end of the seventh transistor is connected to the anode of the light-emitting diode, the control end of the seventh transistor is driven by a second scanning signal;

further comprising a fifth and a sixth transistor;

wherein, each of the fifth and the sixth transistor comprises a control end, a first end and a second end, the first end of the fifth transistor is connected to the first node, the second end of the sixth transistor is connected to the second node, and an initialization voltage signal is inputted to the second end of the fifth transistor and the first end of the sixth transistor, wherein a driving timing of the pixel compensating circuit comprises:

an initialization phase, wherein the second scanning signal driving the sixth transistor has a first logic state to switch on the sixth transistor, and initialize a potential of the second node to equal to a potential $V_{INT}$ of the initialization voltage signal;

a data writing phase, wherein the first scanning signal has a first logic state to switch on the first and the second transistor, the data voltage signal $V_{DATA}$ is written to the first node, so as to clamp the potential of the second node to equal to the voltage value that a voltage $V_{DD}$ of the first reference voltage source minus a threshold voltage $V_{TH}$ of the third transistor;

an emitting phase, wherein the enable signal driving the fourth and the fifth transistor has a first logic state, to switch on the fourth and the fifth transistor to drive the light-emitting diode to emit light, and make the potential of the second node jump to equal to $V_{DD} - V_{TH} - (V_{DATA} - V_{INT})$.

2. The pixel compensating circuit according to claim 1, wherein during the emitting phase of the light-emitting diode, electric current $I_D$ passing through the third transistor and the light-emitting diode satisfies:

$$I_D = \frac{1}{2} \times \mu \times C_{OX} \times \frac{W}{L} \times (V_{DATA} - V_{INT})^2$$

wherein, μ represents a carrier mobility of the third transistor, $C_{ox}$ represents a capacitance of gate oxide of the third transistor per unit area, and W/L represents a ratio of width and length of a channel of the third transistor.

* * * * *